US007860447B2

(12) United States Patent
Mori et al.

(10) Patent No.: US 7,860,447 B2
(45) Date of Patent: Dec. 28, 2010

(54) CURLING DEVICE AND IMAGE FORMING APPARATUS

(75) Inventors: Akihito Mori, Toride (JP); Nobuo Sekiguchi, Moriya (JP); Tadaaki Saida, Kashiwa (JP); Satoshi Okawa, Toride (JP); Keita Takahashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 456 days.

(21) Appl. No.: 11/766,635

(22) Filed: Jun. 21, 2007

(65) Prior Publication Data

US 2008/0159795 A1 Jul. 3, 2008

(30) Foreign Application Priority Data

Jul. 3, 2006 (JP) ..... 2006-183895

(51) Int. Cl.
*G03G 15/00* (2006.01)
*B65H 23/34* (2006.01)

(52) U.S. Cl. ..... 399/406; 399/320

(58) Field of Classification Search ..... 399/406
See application file for complete search history.

(56) References Cited

U.S. PATENT DOCUMENTS 5,749,040 A * 5/1998 Muramatsu ..... 399/406
6,259,888 B1 * 7/2001 Kazama et al. ..... 399/406
7,406,292 B2 * 7/2008 Kamiyama ..... 399/406
2005/0063747 A1 * 3/2005 Ushio ..... 399/406
2006/0140696 A1 * 6/2006 Uehara et al. ..... 399/406

FOREIGN PATENT DOCUMENTS

JP 04-251067 A 9/1992
JP 05-309971 A 11/1993
JP 06-258906 A 9/1994
JP 63-027372 A 2/1998
JP 2005-096892 A 4/2005

* cited by examiner

*Primary Examiner*—Daniel J Colilla
*Assistant Examiner*—Allister Primo
(74) *Attorney, Agent, or Firm*—Canon USA, Inc. IP Div

(57) ABSTRACT

A curling device includes a first curling unit configured to curl a sheet in a first direction and a second curling unit. The second curling unit is for curling a sheet which has passed the first curling unit in a second direction which is opposite to the first direction. The curling device also includes an input unit facilitating manual inputting correction values relating to the curling direction and curling amount to be corrected, and a control unit configured to changeably control the curling amount of each of the first curling unit and the second curling unit, to correspond to the correction values input in the first and second input units.

10 Claims, 7 Drawing Sheets

CURLING DEVICE AND IMAGE FORMING APPARATUS

BACKGROUND OF THE INVENTION

1. Field of the Invention

The present invention relates to a curling device and an image forming apparatus.

2. Description of the Related Art

Heretofore, with an image forming apparatus such as a photocopier or printer which forms an image with an electrophotographic method, a toner image formed at an image forming unit is transferred to a sheet transported from a paper supply unit. Thereafter, the sheet is guided to a fusing device, and the unfused toner on the sheet is fused onto the sheet.

Incidentally, a fusing device of a heat pressure fusing method is known whereby a toner image is fused onto the sheet by applying heat and pressure simultaneously to a sheet. However, in the case of this fusing device, the sheet may be physically deformed (curled) in the event of fusing the toner image onto the sheet.

Now, such curling occurs due to the toner transferred onto the sheet melting by being heated at the fusing device, and by the toner shrinking in accordance with the cooling thereafter. Also, the amount of curling of the sheet is influenced by the amount of toner on the sheet and the difference in the amount of toner on the front and back sides of the sheet.

Recently, particularly with full-color image forming devices, the amount of toner on the paper has been increasing to correspond to various types of paper. Due to the ratio of color toner on the sheet increasing, the amount of curling increases accordingly. Therefore, in order to increase the quality of the output sheets, the curling of sheets needs to be corrected.

Thus, with a current image forming apparatus, a curling device is provided, which has a correcting unit for curling the sheet in the opposite direction as the curling occurring to the sheet, to correct the curling of the sheet.

Note that a correcting method with this correcting unit includes performing curling correction automatically based on the amount of toner on the front and back sides of the sheet when printing duplex, for example (see Japanese Patent Laid-Open No. 06-258906) or changing the curling correction amount automatically for multiplex copying and duplex copying (Japanese Patent Laid-Open No. 63-027372).

Also, correcting methods are known wherein the curling correction amount is automatically measured from the paper type or percentage of moisture content in the paper (see Japanese Patent Laid-Open No. 04-251067) or wherein the curling correction amount is automatically determined by sheet processing conditions or heat amount (see Japanese Patent Laid-Open No. 05-309971).

However, with such curling device and image forming apparatus, curling amounts from temperatures and moisture amounts differ based on recent increased paper product types with various paper properties, and thus automatically setting the optimal curling correction amount for a new sheet has become more difficult. Also, in order to improve quality of the output sheet which is the final product, a higher precision is required for the correction of curling amount after output, so as to avoid unsightly curling.

Thus, curling correction of the sheet has become difficult with automatic control only. As disclosed in Japanese Patent Laid-Open No. 2005-096892 and Japanese Patent Laid-Open No. 2002-080157, fine-tuning by user input is being considered, as opposed to automatic control, for curling correction.

Japanese Patent Laid-Open No. 2005-096892 discloses a device whereby manual change means for manually changing the curling correction amount is provided, the manually set correction value is stored, and the stored correction amount can be reused. Also, the setting conditions used with automatic control means can be replaced with the manually set correction value. The configuration of Japanese Patent Laid-Open No. 2005-096892 applies curling in one direction and cannot respond to curling in the opposite direction.

With the configuration described in Japanese Patent Laid-Open No. 2002-080157, a sheet is transported to one of a first curling portion which adds curling in one direction and a second curling portion which adds curling in the other direction, thereby responding to curling in both directions. The levels of curling correction force by the two curling portions can each be set.

Now, for example, the user himself/herself must think and set the level of curling correction force so as to minimize curling as to the opposite direction of the sheet having passed through the curling portion, thus operability is poor. Particularly, one case that can be considered is a situation wherein the sheet having passed through the first curling portion is curled, for example, and the second curling portion is used, a sheet with a straight shape is obtained. In this case, with the configuration in Japanese Patent Laid-Open No. 2002-080157, the user himself must switch the curling portion to operate, and perform setting of the curling correction force levels himself also. Accordingly, depending on the user, the user may not think to perform such switching settings, or may erroneously set the curling correcting force levels according to the switching settings. Thus, the configuration in Japanese Patent Laid-Open No. 2002-080157 does not have high operability for a user when performing curling fine-tuning input.

SUMMARY OF THE INVENTION

The present invention is directed to a sheet conveyance apparatus and image forming apparatus with improved operability in the event of adjusting the curling amount with manual inputs.

According to an aspect of the present invention, a curling device includes a first curling unit for curling a sheet in a first direction, a second curling unit for curling a sheet which has passed the first curling unit in a second direction opposite to the first direction, an input unit facilitating manual inputting correction values relating to the curling direction and curling amount to be corrected, and a control unit configured to automatically change the curling amount of each of the first curling unit and the second curling unit to correspond to the correction values input in the input unit.

According to the present invention, operability when manually inputting adjustments to curling amount is improved.

Further features of the present invention will become apparent from the following description of exemplary embodiments with reference to the attached drawings.

DESCRIPTION OF THE EMBODIMENTS

An embodiment of the present invention will be described in detail with reference to the diagrams.

Figure 1:
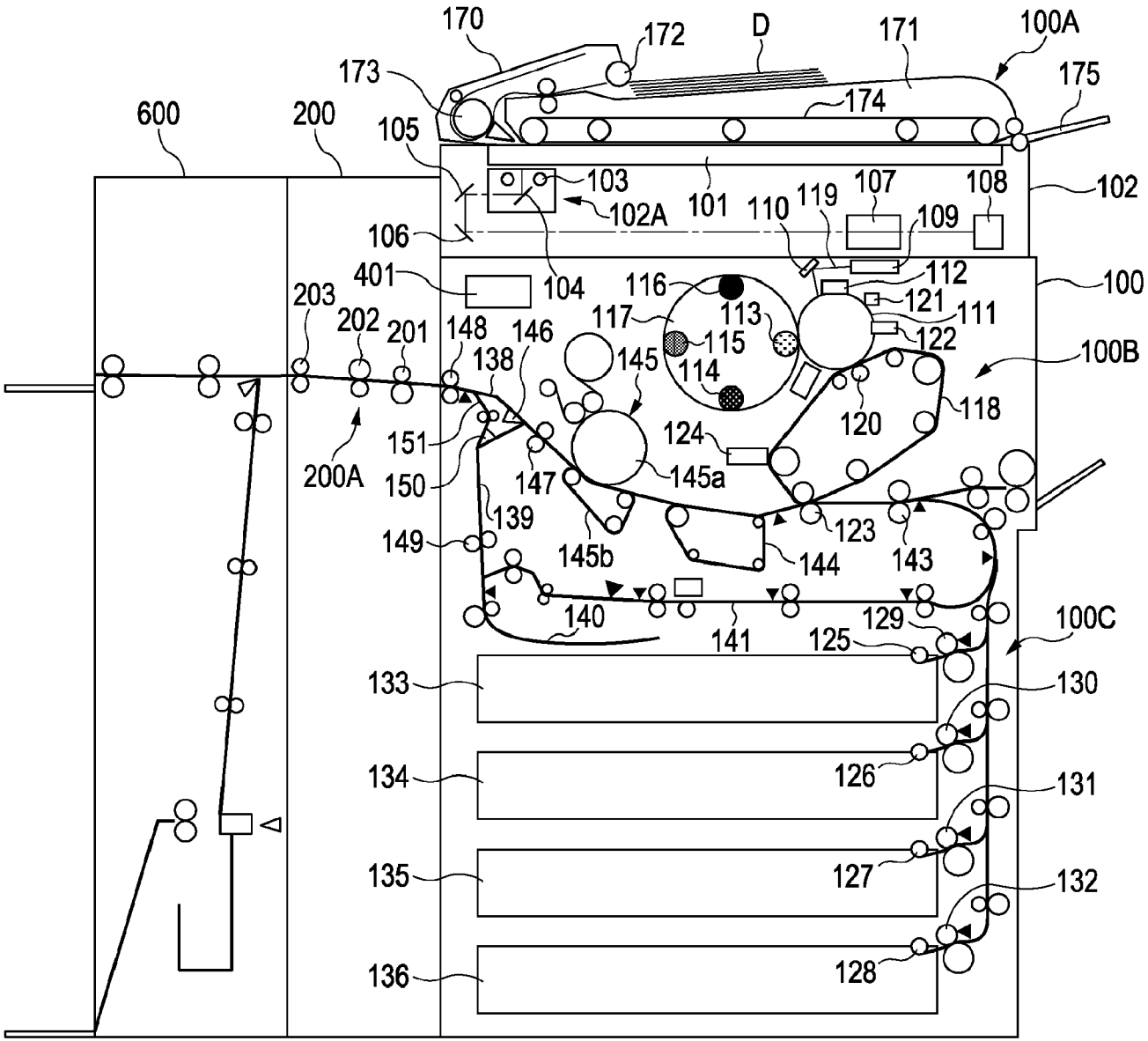
FIG. 1 is a diagram showing a configuration of an image forming apparatus having a sheet transport apparatus according to an embodiment of the present invention.

FIG. 1 is a diagram showing a configuration of an image forming apparatus having a sheet transport apparatus according to an embodiment of the present invention. In FIG. 1, reference numeral 100A denotes an image forming apparatus capable of forming a color image, reference numeral 100 denotes an image forming apparatus main unit (hereafter called apparatus main unit), reference numeral 600 denotes a finisher which is a sheet processing device, and reference numeral 200 denotes a curl-removing device provided between the apparatus main unit 100 and the finisher 600. Note that reference numeral 200A denotes a sheet transport apparatus provided at the curl-removing device 200.

On the upper portion of the apparatus main unit 100 is provided an image reader device 102 for reading a document D placed on a platen glass 101, serving as a document placing stand, by an automatic document feeding device 170. A light source 103, mirrors 104 through 106, a lens 107, and an image sensor unit 108 having a CCD sensor are provided on the image reader device 102.

Note that the automatic document feeding device 170 is for automatically feeding the document D to a position where a reader unit 102A having the light source 103 and mirror 104 can read the document image, and has a document tray 171 capable of holding a maximum of 100 sheets of document.

Also, the automatic document feeding device 170 has a document feeding roller 172 for feeding the document D, and a two-sided document reverse roller 173 for reading both sides of the document D fed from the document feeding roller 172. Further, a document transport belt 174 is provided for placing the document D, which is transported from the document feeding roller 172 or the two-sided document reverse roller 173, onto the platen glass 101.

Note that the document transport belt 174 is controlled so as to stop the document D at a reading position, or transporting the document D backwards to the two-sided document reverse roller 173 in the care of reading the back face of the document D, or transporting the document D so as to be discharged into a document discharge tray 175. Note that the maximum number of sheets to be stacked in the document discharge tray 175 is 100 sheets, which is the same as the document placing stand 171.

Also, on the lower portion of the image reader device 102, an image forming unit 100B and a paper feed unit 100C for feeding the sheets S to the image forming unit 100B is provided.

A photosensitive drum 111 is provided on the image forming unit 100B. Further, around the periphery of the photosensitive drum 111 is a forward exposure lamp 121 for eliminating electrical potential on the photosensitive drum 111 and a primary charger 112 for corona discharge by applying high pressure on a wire to load the potential to the photosensitive drum 111.

Also, around the periphery of the photosensitive drum 111 is a rotary developer 117, containing developers 113 through 116 filled with toner which develops electrostatic latent images formed on the photosensitive drum 111, and a cleaning device 122.

Note that in FIG. 1, reference numeral 109 denotes an exposure control unit configured with a laser, a polygon scanner, and so forth. This exposure control unit 109 irradiates a laser beam 119, modulated based on image signals subjected to predetermined image processing to be described later, obtained by optical information being converted to electrical signals by the image sensor unit 108, and modulated, onto the photosensitive drum 111.

Now, the photosensitive drum 111 is rotated by an unshown motor. The drum 111 is charged to a desired potential by the primary charger 112. The laser beam 119 from the exposure control unit 109 is irradiated with an angle changed by a folding mirror 110. Thus, an electrostatic latent image is formed on the photosensitive drum 111. By rotating the rotary developer 117, the toner within the respective developers 113 through 116 adheres electrostatically to the electrostatic latent image, and thus a toner image is formed on the photosensitive drum 111.

Further, a seamless transfer belt 118 onto which is transferred a layered four-color toner image formed sequentially on the photosensitive drum 111, and a secondary transfer roller 123 which transfers the toner image that has been transferred to the transfer belt 118 onto a sheet, are provided on the image forming apparatus 100B. Also, a primary transfer roller 120 which performs primary transfer of the developed toner image on the photosensitive drum 111 onto the transfer belt 118 is disposed at a position facing the photosensitive drum 111 via the transfer belt 118.

The paper feed unit 100C is provided on the apparatus main unit 100 so as to be detachable, and also has cassettes 133 through 136 for storing sheets such as recording sheets, OHP sheets, and the like, and pickup rollers 125 through 128 for feeding the sheets stored in the cassettes 133 through 136.

At the upstream side of the image forming unit 100B, a resist roller 143 is provided, which increases the orientation/position precision of a sheet S so as to feed the sheet along with the toner image on the transfer belt with good timing. Also, a transfer transporting device 144 for transporting the sheet onto which the toner image is transferred, a fusing unit 145 for fusing the unfused image on the sheet, and a discharge roller 148 for discharging the sheet S having the fused image to the exterior of the apparatus main unit, are provided at the downstream side of the image forming unit 100B.

Note that in FIG. 1, reference numeral 401 denotes a job control unit which controls the overall image forming operation of the apparatus main unit 100. Also, reference numeral 124 denotes a belt cleaner which cleans the remaining toner on the transfer belt.

Next, the image forming operation of an image forming apparatus 100A with such a configuration will be described. Upon a feed signal being output from the job control unit 401 provided to the apparatus main unit 100 for example, a light from the light source 103 is shone on the document D placed on the platen glass 101 by the automatic document feeding device 170, and reflected. The light reflected from the document D travels via the mirrors 104 through 106 and the lens 107, is read by the image sensor unit 108, and subsequently converted to an electric signal.

Subsequently, the laser beam 119 corresponding to this electric signal is irradiated from the exposure control unit 109 by the folding mirror 110, towards the rotating photosensitive drum 111, at a changed angle. Thus, an electrostatic latent image is formed on the photosensitive drum.

Subsequently, the image forming apparatus 100A rotates the developing rotary 117 so as to move the developer 113 with the first color to make contact with the photosensitive drum 111, and causes the toner within the developer 113 to electrostatically adhere to the electrostatic latent image. Thus, an electrostatic latent image is formed, a toner image is formed on the photosensitive drum 111, and the toner image on the photosensitive drum 111 is temporarily transferred to the transfer belt 118 by the primary transfer roller 120.

Note that in the event of forming a full-color image, the toner image with the first color formed on the photosensitive drum 111 is temporarily transferred to the transfer belt 118, and at the same time the image forming apparatus 100A rotates the developing rotary 117 so as to move the developer 114 with the second color to make contact with the photosensitive drum 111.

Subsequently, a laser beam 119 is irradiated again, at a timing wherein the leading edge of the toner image of the first color which is temporarily transferred onto the transfer belt and the leading edge of the toner image of the second color formed on the photosensitive drum 111 match completely. Thus, an electrostatic latent image is formed on the photosensitive drum 111, this electrostatic latent image is developed by the developer 114, and a toner image is formed.

Subsequently, the toner image of the second color is transferred so as to be layered on top of the toner image of the first color which is temporarily transferred on the transfer belt 118. By repeating this layering with the third color and the fourth color, a four-color full-color toner image is transferred onto the transfer belt 118.

On the other hand, the sheet stored in one of paper feed cassettes 133 through 136 and fed by pickup rollers 125 through 128 is transported toward the resist roller 143 by paper feed rollers 129 through 132. The resist roller 143 is stopped at this time, and any skewing of the sheet is corrected by the resist roller 143 which is stopped.

Subsequently, the image forming apparatus 100A drives the resist roller 143 so that the leading edge of the toner image on the transfer belt 118 and the leading edge of the sheet matches. Thus, the toner image is transferred onto the sheet by a transfer pressing applied to the secondary transfer roller 123 at the transfer unit configured with the transfer belt 118 and the secondary transfer roller 123.

Note that following the toner image being transferred to the sheet, the transfer belt cleaner 124 cleans the remaining toner not transferred onto the sheet by the secondary transfer roller 123 from the transfer belt 118. This transfer belt cleaner 124 is detachable as to the transfer belt 118, and is controlled so as to make contact with the transfer belt 118 immediately prior to the leading edge of the remaining toner arriving at the transfer belt cleaner 124. Also, the transfer belt cleaner 124 is controlled so as to move away when the image of the first color of the next unfused toner image is transferred to the transfer belt 118 by the primary transfer roller 120 and the leading edge of the image thereof arrives immediately prior to the transfer belt cleaner 124.

Also, with the photosensitive drum 111, following the toner image being transferred to the transfer belt 118 by the primary transfer roller 120, the toner remaining on the photosensitive drum 111 is cleaned by the photosensitive drum cleaning device 122. Subsequently, the remaining charge on the photosensitive drum 111 is deleted by the forward exposure lamp 121.

Next, the sheet whereupon such toner image is transferred is transported to the fusing device 145 made up of a heat roller 145*a* and a fusing belt 145*b* for pressure bonding to the heat roller 145*a* from below, by the transfer transport device 144. The sheet whereupon a toner image is transferred is subjected to pressure and heat by the fusing device 145, and so the toner image is fused thereto. Subsequently, the sheet is discharged to the exterior of the apparatus main unit 100 by an inner discharger roller 147 and the discharge roller 148.

Note that the present image forming apparatus 100A has a duplex image forming function, and has a discharge sheet flapper 146 which switches the sheet path between one of a transport path 139 and a discharge path 138.

In the event of duplex recording (duplex copying) to form an image on both sides of a sheet, the discharge flapper 146 is rotated upwards. Thus, the sheet to be fed out from the inner discharge roller 147 is transported from the transport path 138 to the duplex reverse transport path 140 after temporarily being inserted in the reverse path 139.

Subsequently, the sheet is transported from a duplex reverse transport path 140 to a re-feed path 141. Thus the sheet passes through the re-feed path 141 in the state of being upside-down, and following this, is transported again towards the image forming unit 100B. A toner image is formed on the second face of the sheet S which has thus been transported again to the image forming unit 100B by the above-described image forming process.

Note that in the event of reversing and discharging the sheet from the apparatus main unit 100, following the discharge flapper 146 being rotated upwards, the sheet is fed into the reverse path 139 by a reverse roller 149 to a position where the trailing edge of the sheet is in the state of having passed a reverse flapper 150. Subsequently, by rotating the reverse roller 149 in the opposite direction while rotating the reverse flapper 150 downward, the sheet is flipped over and fed out to the discharge roller 148 side via a reverse external discharge path 151.

Incidentally, the sheet thus discharged to the outside of the apparatus main unit 100 by the discharge roller 148 is subjected to correction of the curling which is formed by curling being applied by the curl-removing device 200, following which the sheet is transported to the finisher 600 to be subjected to predetermined processing such as binding or the like.

Now, the curl-removing device 200 has an upper curling roller pair 201. The roller pair 201 applies a corrective force to the sheet so that both edges in the sheet transport direction bend upwards so as to correct the curling of the sheet in the first direction wherein both edges in the sheet transport direction bend downwards (hereafter called lower curling). Also, the curl-removing device 200 has a lower curling roller pair 202. The roller pair 202 applies a corrective force to the sheet so that both edges in the sheet transport direction bend downwards so as to correct the curling of the sheet in the second direction wherein both edges in the sheet transport direction bend upwards (hereafter called upper curling). The curl-removing device also has a buffer discharge roller 203.

That is to say, the sheet transport apparatus 200A has the upper curling roller pair 201 serving as a first curling unit for curling the sheet in a first direction, the lower curling roller pair 202 serving as a second curling unit for curling the sheet in a second direction opposite to the first direction, and the buffer discharge roller 203. Note that curling the sheet in the upper curling direction does not indicate that upper curling is formed on the sheet having been subjected to the upper curling unit, but rather indicates that the sheet subjected to the upper curling unit is curled so as to bend in the upper curling direction as compared to the sheet prior to the upper curling unit. Curling the sheet in the lower curling direction does not indicate that lower curling is formed on the sheet having been subjected to the lower curling unit, but rather indicates that the sheet subjected to the lower curling unit is curled so as to bend in the lower curling direction as compared to the sheet prior to the lower curling unit.

When the sheet transport apparatus 200A receives the sheet from the discharge roller 148, the sheet is subjected to curling so as to correct the curling with the upper curling roller pair 201 and the lower curling roller pair 202. Thereafter, the sheet is discharged by the buffer discharge roller 203 to the processing device 600.

Now, the upper curling roller pair 201 and the lower curling roller pair 202 are made up of a first roller with a soft surface such as a sponge roller or the like, for example, and a second roller pressing against this first roller.

FIG. 2 is a diagram showing the configuration of the lower curling roller pair 202. As shown in FIG. 2, the lower curling roller pair 202 is made up of a sponge roller 202*a*, serving as a first roller, and a lower roller 202*b*, serving as a second roller, which presses against the sponge roller 202*a*.

In FIG. 2, reference numeral 202*c* denotes a roller shaft of the sponge roller 202*a*, wherein this roller shaft 202*c* is supported so as to be movable in the vertical direction while being attached at the upper portion to an unshown frame of the curling device 200 by an unshown attaching unit. Reference numeral 202*d* denotes a bearing making contact with the roller shaft 202*c* from the upper side, whereupon an eccentric cam 202*e* makes contact with the bearing 202*d* from the upper side.

Figure 2A:
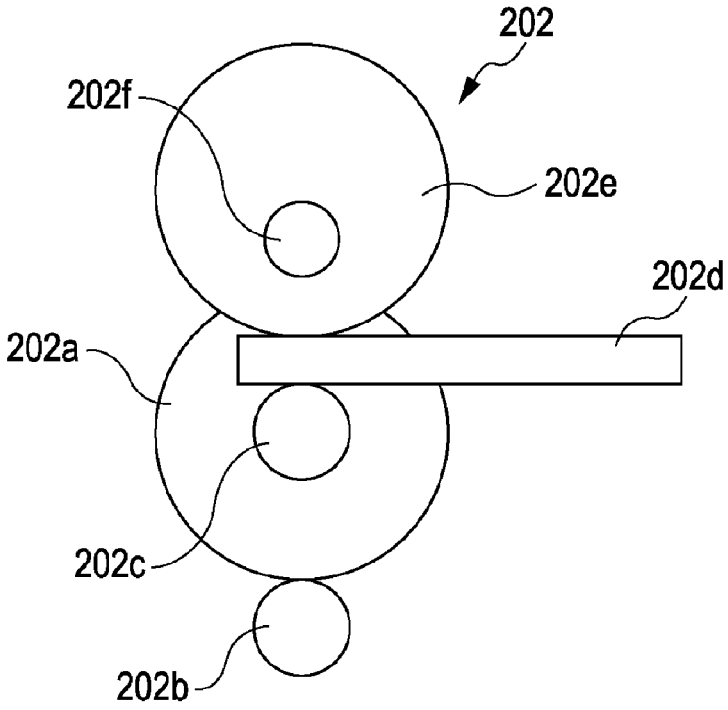
FIG. 2A is a diagram showing a configuration of a lower curling roller pair, illustrating a state of minimum curling amount.
Figure 2B:
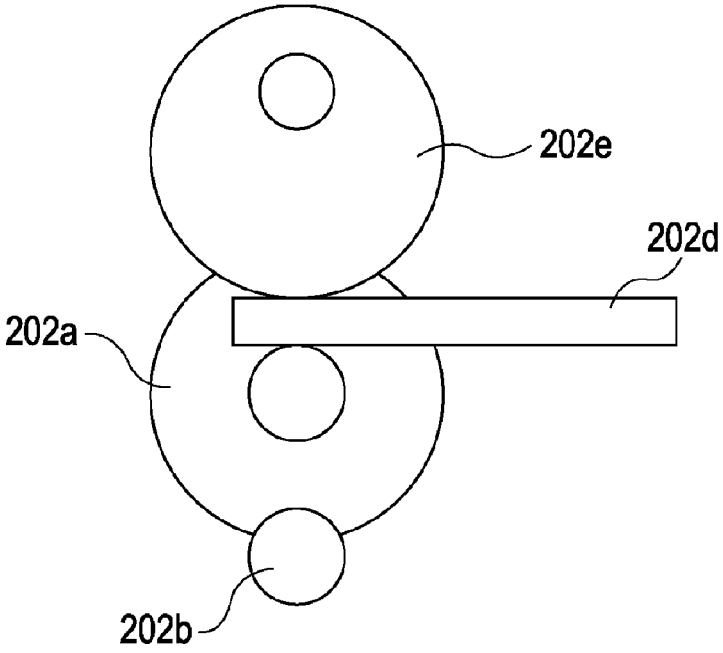
FIG. 2B is a diagram showing a configuration of a lower curling roller pair, illustrating a state of maximum curling amount.

If the eccentric cam 202*e* rotates from the position shown in FIG. 2A, for example, with a shaft 202*f* as a supporting point, the bearing 202*d* is pressed down by the shape of the eccentric cam 202*e*. Accordingly, the roller shaft 202*c* integrated with the sponge roller 202*a* are pressed down by the pressing force of the attaching unit, whereby the lower roller 202*b* digs into the downstream side of the sponge roller 202*a*. Note that when the eccentric cam 202*e* rotates 180°, as shown in FIG. 2B, the amount that the lower roller 202*b* digs into the sponge roller 202*a* is the maximum.

In other words, with the present embodiment, by adjusting the rotation angle of the eccentric cam 202*e*, the position of the roller shaft 202*c* in the vertical direction can be determined, and thus the amount of the lower roller 202*b* digging into the sponge roller 202*a* can be changed (adjusted). By changing the digging in amount, the curling amount (correction force) can be changed.

Note that the position of the eccentric cam 202*e* shown in FIG. 2A is at a state with no correction, and with the present embodiment, the digging in amount can be changed by driving the eccentric cam 202*e* by 36° at a time, for example, from this position.

Figure 3A:
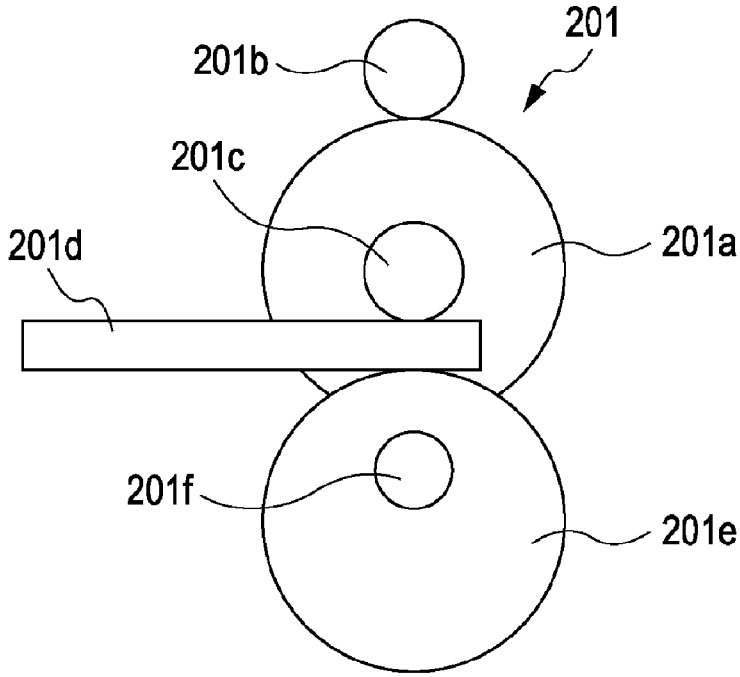
FIG. 3A is a diagram showing a configuration of a lower curling roller pair, illustrating a state of minimum curling amount.
Figure 3B:
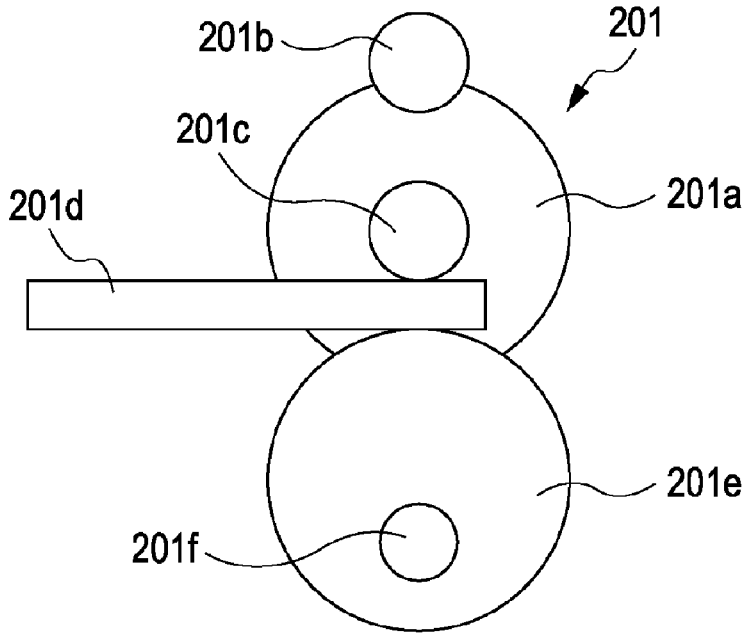
FIG. 3B is a diagram showing a configuration of an upper curling roller pair, illustrating a state of maximum curling amount.

Description has been given regarding the configuration of the lower curling roller pair 202, but as shown in FIGS. 3A and 3B, as with the case of the lower curling roller pair 202, the upper curling roller pair 201 also has a similar configuration and operation in that the disposition of the sponge roller and the lower roller are inverted in the vertical direction. That is to say, the upper curling roller pair 201 is made up of a sponge roller 201*a* which rotates with the roller shaft 201*c* in the center thereof, and a lower roller 201*b*. With an eccentric cam 201*e* rotating with a shaft 201*f* as a supporting point, a bearing 201*d* supporting the roller shaft 201*c* is pressed up by the shape of the eccentric cam 201*e*.

The amount of curling is adjusted by the rotation position of the eccentric cam 201*e*, as well as the upper curling roller pair 201 and lower curling roller pair 202, being subjected to control by the curling control unit to be described below.

Now, the amount of curling of the sheet is small when the sheet passes the fusing device 145, but the greater the amount of toner fused onto the sheet, the greater the amount of curling that will occur as time passes. Thus, in order to reduce the amount of curling after a predetermined amount of time passing, an inverse curl is applied by the curling device 200 and the sheet is output, being subjected to control so that there is no curling after a predetermined amount of time passing.

This correction method is a method wherein the digging in amount of the upper curling roller pair 201 and the lower curling roller pair 202 is divided into several stages and the digging in amount changed according to the amount of toner. For example, by driving the eccentric cam 202*e* by 36° each time, five stages of digging in amount control can be made, wherein the digging in amount 5 has the greatest amount of digging in, and is subjected to the greatest reverse curling. If we say that the greatest amount of toner on the sheet is a toner amount of 100%, the state in which the amount of toner is 100% has the greatest amount of curling after a predetermined amount of time passing, and so the digging in amount 5 is set for this state.

Note that the relation between the respective digging in amounts 1 through 5 and the angle of the eccentric cam 202*e* is as shown below. Also, when the angle is rotated 30°, the roller pair digs in by 1 mm. Further, setting of the toner amount, that is to say the digging in amount corresponding to the curling amount, is automatically performed by the job control unit 401 shown in FIG. 4, which will be described later.

| | |
|---|---|
| No correction: | 0° (the state in FIG. 2A) |
| Digging in amount 1: | 36° |
| Digging in amount 2: | 72° |
| Digging in amount 3: | 108° |
| Digging in amount 4: | 144° |
| Digging in amount 5: | 180° (the state in FIG. 2B) |

For example, in the case that the sheet with an image formed on one side thereof is discharged from the apparatus main unit 100, the sheet is transferred to the curling device 200 in the state of toner being on only the upper face of the sheet. This sheet curls upwards after a predetermined amount of time. So in this case, curling is performed by controlling the digging in amount of the lower curling roller pair 202 according to the amount of toner.

In the case of one-sided printing:

Toner amount of 81-100%: Lower curling (digging in amount 5)

Toner amount of 61-80%: Lower curling (digging in amount 4)

Toner amount of 41-60%: Lower curling (digging in amount 3)

Toner amount of 21-40%: Lower curling (digging in amount 2)

Toner amount of 1-20%: Lower curling (digging in amount 1)

Toner amount of 0%: Lower curling (no correction)

In the case of duplex printing, there is toner on both the front face (upper face) and back face (lower face). Therefore, determination is made as to whether the upper curling roller pair 201 is to be used or the lower curling roller pair 202 is to be used, based on the difference in the amount of toner.

In the case that the amount of toner on the front face (upper face) is greater than the amount of toner on the back face (lower face), the sheet curls upward. Thus, the difference between the front face toner amount and back face toner amount is calculated, and curling correction is performed by controlling the digging in amount of the lower curling roller pair 202 based on the difference in toner amount.

Toner amount of 81-100%: Lower curling (digging in amount 5)

Toner amount of 61-80%: Lower curling (digging in amount 4)

Toner amount of 41-60%: Lower curling (digging in amount 3)

Toner amount of 21-40%: Lower curling (digging in amount 2)

Toner amount of 1-20%: Lower curling (digging in amount 1)

Toner amount of 0%: Lower curling (no correction)

In the case that the amount of toner on the front face (upper face) is less than the amount of toner on the back face (lower face), the sheet curls downward. Thus, the difference between the back face toner amount and front face toner amount is calculated, and curling correction is performed by controlling the digging in amount of the upper curling roller pair 201 based on the difference in toner amount.

Toner amount of 81-100%: Upper curling (digging in amount 5)

Toner amount of 61-80%: Upper curling (digging in amount 4)

Toner amount of 41-60%: Upper curling (digging in amount 3)

Toner amount of 21-40%: Upper curling (digging in amount 2)

Toner amount of 1-20%: Upper curling (digging in amount 1)

Toner amount of 0%: Upper curling (no correction)

Figure 4:
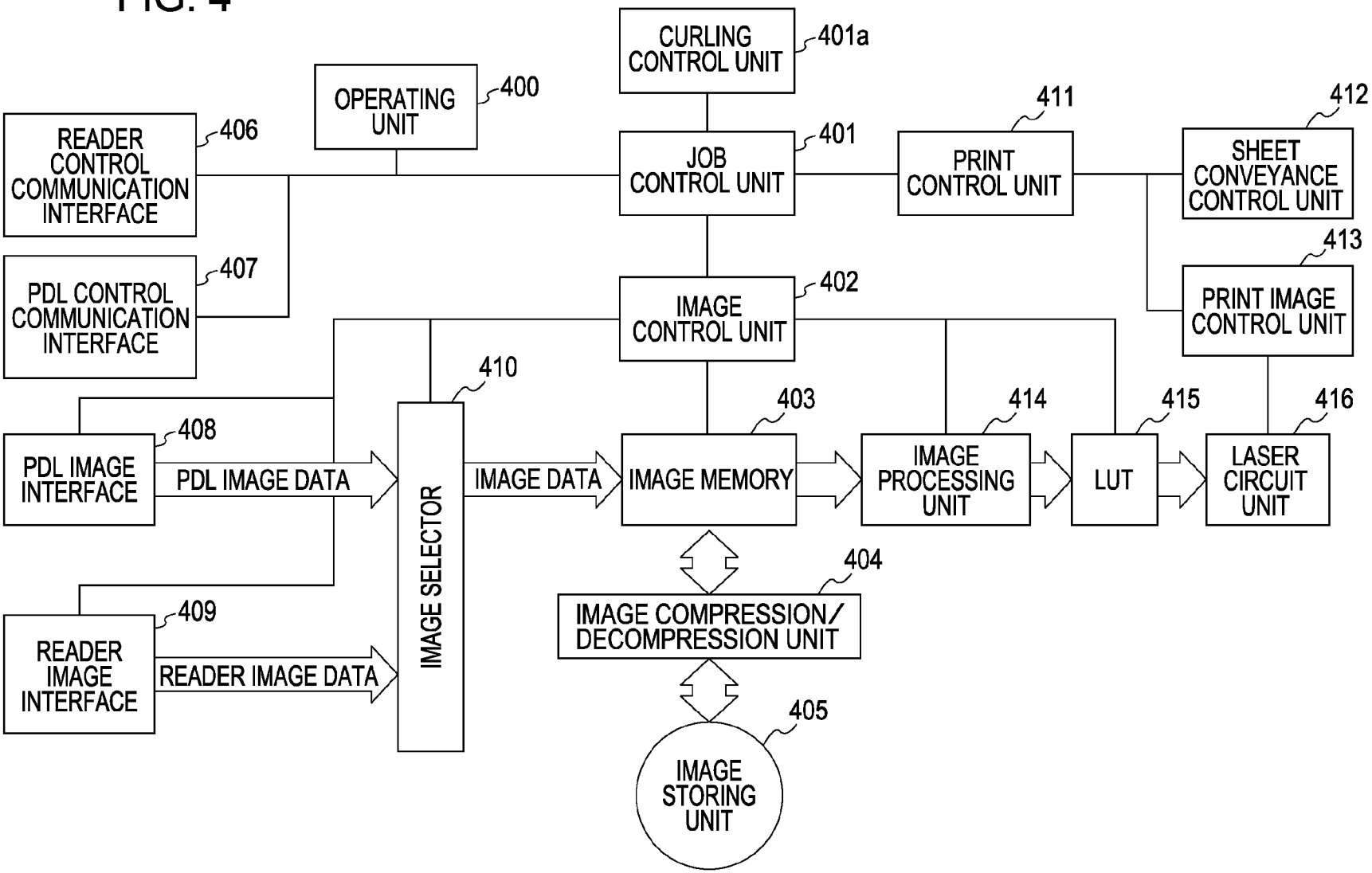
FIG. 4 is a control block diagram of an image forming apparatus.

FIG. 4 is a control block diagram of the image forming apparatus 100A. In FIG. 4, the reference numeral 401 is a job control unit serving as the control for the entire image forming apparatus 100A. This job control unit 401 includes an unshown ROM with a program for controlling the image forming apparatus 100A written therein, a RAM for deploying the program, a CPU for executing the program, and so forth.

The reference numeral 400 denotes an operating unit that is connected to the job control unit 401, and the content specified at the operating unit 400 is notified to the job control unit 401. At the job control unit 401, copy jobs, scan jobs, and so forth are generated according to the operation mode notified by the program.

Also, the job control unit 401 is connected to a reader control communication interface 406 serving as a communication interface with an unshown CPU circuit for controlling an image reader device (reader) 102 which reads the document image. Also, the job control unit 401 is connected to a PDL control communication interface 407 serving as a communication interface with a CPU circuit of an unshown PDL image control unit which deploys PDL image data transmitted from an unshown personal computer or the like to a bitmap image.

Further, the job control unit 401 is connected to an image control unit 402 for controlling the image data until the image data is generated for transmitting a PDL image or reader image to the image forming unit 100B of the image forming apparatus 10A, a print control unit 411 which drives to control the various loads and forms an image, and so forth.

The image control unit 402 is a circuit for performing settings of each image related circuit according to the jobs generated at the job control unit 401. This image control unit 402 is connected to an image selector 410 which determines which image data will be valid for a volatile image memory 403, of PDL image data transmitted from a PDL image interface 408 and reader image data transmitted from a reader image interface 409. Also, the image control unit 402 sets which region to store the image data from the image selector 410 as to the image memory 403.

Further, the image control unit 402 performs settings for the image storing unit 405 configured with a non-volatile memory and settings to compress the bitmap image data from the image memory 403 and transmit this to the image storing unit 405. Also, the image control unit 402 decompresses the compressed image data from the image storage unit 405 and performs settings of an image compression/decompression unit 404 to return this to the image memory 403 again. Also, the image control unit 402 reads out color image data from the image memory 403 for actual developing and printing, and performs desired image processing at an image processing unit 414.

With the curling control unit 401*a*, the curling amount of the lower curling roller pair 202 and upper curling roller pair 201 are controlled based on instructions from the job control unit 401. In other words, the curling control unit 401*a* controls the digging in amount of the lower curling roller pair 202 and upper curling roller pair 201 by controlling the rotation position of the eccentric cam.

With the print control unit 411, image data of the colors are received which are transmitted finally by an unshown color division unit, according to the various settings of the image control unit 402 set by the content specified by the job control unit 401. The print control unit 411 issues instruction to the print image control unit 413 so as to transmit the image data with these colors to a laser circuit unit 416.

Also, with the print image control unit 413, settings are performed regarding the image data, with a LUT (Look Up Table) which reflects the sensitivity properties of the photosensitive drum, according to the instructions from the print control unit 411. This LUT 415 also serves to change the image density as to the input image data in the case that the image density is not the desired density due to changes in the sensitivity properties of the photosensitive drum, the amount of laser exposure, the charge amount from the primary charger, and so forth, and converts the image density so that the desired density is output.

The image data having been subjected to the LUT 415 for each color is output to the laser circuit unit 416, and a latent image thereof is formed on the photosensitive drum by the respective developers 113 through 116. At the laser circuit unit 416, the image data input via the LUT 415 is continually counted, and is transmitted to the print control unit 411 via the print image control unit 413 as video data. The print control unit 411 adds the video data for all of the colors based on this video data, stores this as the toner amount, and with the maximum toner amount set as 100%, stores the information of the percentage that the toner amount will be for each sheet.

The job control unit 401 controls the sheet curling amount of the upper curling roller pair and lower curling roller pair via the curling control unit 401*a*, based on the toner amount stored in the print control unit 411.

Further, the print control unit 411 is synchronized with the print image control unit 413 as to the sheet transport control unit 412, and transfers the full-color toner image which has been formed on the intermediate transfer belt 118 to the sheet fed from the cassettes 130 through 133. Further, the print control unit 411 performs control so as to feed the sheet with the transferred toner image through the fusing device 145 and the image to be formed on the sheet.

Figure 5:
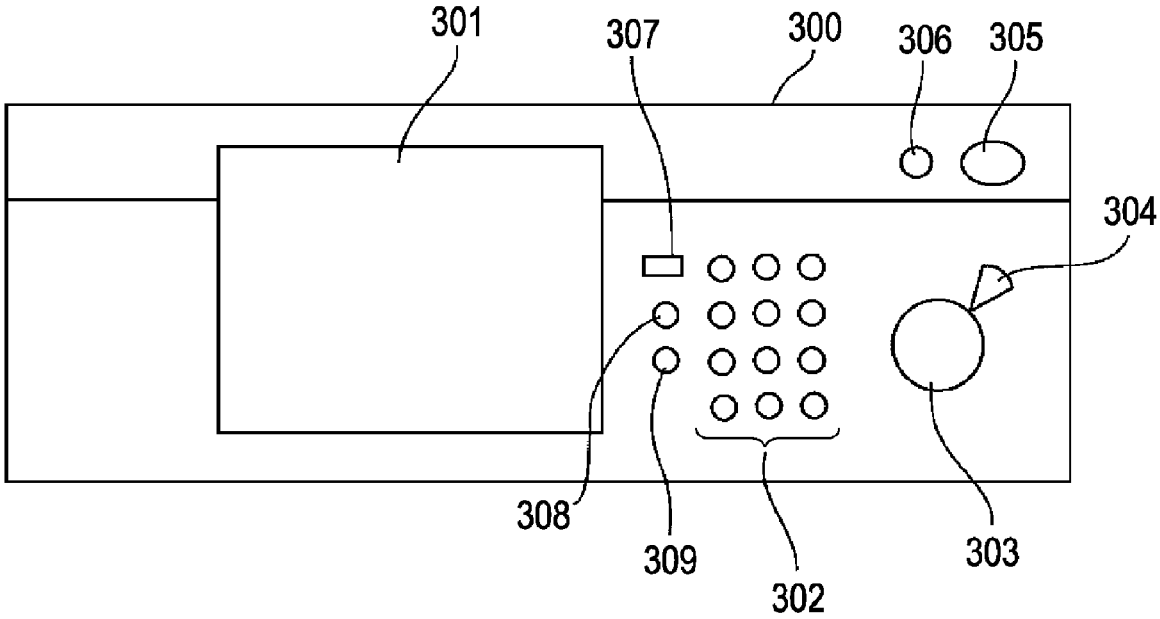
FIG. 5 is a diagram describing an operating unit of the image forming apparatus.

FIG. 5 shows an operating panel controlled by the operating unit 400 shown in FIG. 4, and has a touch-panel type of LCD display 301 wherein mode settings or status display of the image forming apparatus 100A is performed.

Note that in FIG. 5, the reference numeral 302 denotes a 10-key pad having number inputs of 0 through 9 and a clear key for returning the settings to a default value. The reference numeral 309 denotes a user mode key including adjustment modes for executing adjustment items such as default value settings for various functions of the image forming apparatus 100A or gradation corrections which the user can arbitrarily perform. Further, the user mode key 309 is a key for performing settings of various types of networks such as an IP (Internet Protocol) address.

The reference numeral 303 denotes a start key which is pressed when executing copy functions, scanning functions, or the like. The reference numeral 304 denotes a stop key which is pressed when executing copy functions, print functions, scanning functions, or the like. The reference numeral 305 denotes a "soft power source" key, to be used when the power load of the image forming device motor or the like is desired to be lowered but the CPU or network or the like is desired to remain activated.

The reference numeral 306 denotes a power-save mode key, and is a key which the user presses for controlling temperature adjustments at a level wherein the temperature adjustment control of the fusing device 145 is set with the user mode. The reference numeral 307 denotes a reset key which is a key for resetting the functions set by the LCD display unit 301 or the 10-key pad 302 to default values. The reference numeral 308 denotes a guide key for displaying descriptions of the various user modes which are set and executed by the user mode key 309, and the various copy functions, print functions, scan functions set at the LCD display unit 301. This operating panel 300 enables the user to use the image forming apparatus 100A.

Incidentally, the digging in amount of the upper curling roller pair 201 and lower curling roller pair 202 (curling amount) is automatically determined from the toner amount by the job control unit 401 serving as the curling amount determining unit, as described above. However, there are instances where the curling of a sheet cannot be removed when curling correction is performed with such automatic control.

Thus, the present embodiment is configured so that manual curling adjusting by the user can be performed in such instances. That is to say, the user can input a correction value for correcting the curling amount determined at the job control unit 401, from the operating unit 400 serving as the input unit, as to the digging in amount automatically determined by the toner amount.

Figure 6:
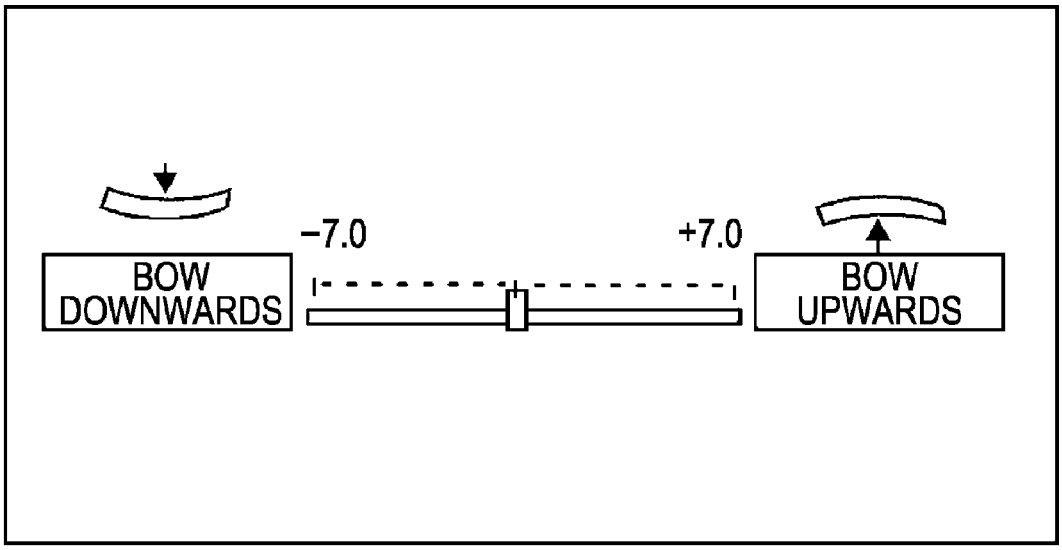
FIG. 6 is a diagram describing a screen for curling correction displayed on an LCD display unit provided on an operating panel of the image forming apparatus.

FIG. 6 is a screen image for offset adjusting relating to the curling which can be set by the user, and is displayed on an LCD display unit 301 of the operating panel 300. The user can input correction values from the screen in FIG. 6.

For example, in the case of a sheet discharged from the image forming apparatus in the state of the image facing upwards is curled downwards, the user can scroll in a negative direction. In the case of a sheet discharged from the image forming apparatus in the state of the image facing upwards is curled upwards, the user can scroll in a positive direction. In other words, the negative direction to be input here indicates that the correction will be made by bending in the upper curling direction as the correction direction for correcting the curling. The positive direction indicates that the correction will be made by bending in the lower curling direction as the correction direction for correcting the curling.

Manual input is thus made regarding the correction direction and correction amount as to the sheet discharged from the image forming apparatus, and the user can freely adjust the curling amount. Operability is good, since correction values showing the opposite direction of the curling of the discharged sheet are input. Note that this setting can be performed for each of various types of sheets, and the set values are stored in the memory within the job control unit 401.

Now, for example, in the case that the sheet discharged from the image forming apparatus is curled upwards, the user makes the setting to be "+1" so that the sheet is curled in the opposite direction (downward curling direction) of the upward curling. The curling control unit 401*a* controls the digging in amount of the lower curling roller pair 202 based on this input so as to increase the digging in amount by one stage. Thus, at the time of the next image forming, the sheet is curled downward only one stage worth, and so the number of curled discharged sheets decrease.

Also, for example, in the case that the sheet discharged from the image forming apparatus is curled downwards, the user makes the setting to be "−1" so that the sheet is curled in the opposite direction (upward curling direction) of the downward curling. The curling control unit 401*a* controls the digging in amount of the upper curling roller pair 201 based on this input so as to increase the digging in amount by one stage. Thus, at the time of the next image forming, the sheet is curled upward only one stage worth, and so the number of curled discharged sheets decrease.

Now, when the correction amount determined by automatic control by the job control unit 401 is as below, let us say that the user sets "+1" as offset input at the operating panel 300.

Lower curling roller pair: digging in amount 0

Upper curling roller pair: digging in amount 1

In this case, the digging in amount of the lower curling roller pair 202 is 0, and therefore the lower curling roller pair 202 does not perform curling correction to apply downward curling. The upper curling roller pair 201 performs curling correction at one stage so as to apply upward curling. In this state, if the correction value "+1" by the user is reflected as is, the digging in amount of the lower curling roller pair 202 and the upper curling roller pair 201 is as below.

Lower curling roller pair: digging in amount 1

Upper curling roller pair: digging in amount 1

That is to say, the lower curling roller pair 202 performs curling in the downward curling direction at one stage. The upper curling roller pair 202 performs curling in the upward curling direction at one stage. However, in this case, the lower curling roller pair 202 increases the digging in amount, and so the total motor transport torque which drives the lower and upper curling roller pairs 201 and 202 increases.

Even if the digging in amount of the lower and upper curling roller pairs 201 and 202 are set as shown below, the curling results are the same.

Lower curling roller pair: digging in amount 0

Upper curling roller pair: digging in amount 0

In other words, with an example as that described above, in the case that the user input is "+1", that is to say, in the case that the direction of curling correction is in the downward curling direction, rather than increasing the digging in amount of the lower curling roller pair, the digging in amount of the upper curling roller pair is decreased one stage. This results in the same amount of curling being applied to the sheet. That is to say, control is performed so as to decrease the digging in amount of the curling roller pair which curls in the opposite direction of the input curling correction direction.

By not reflecting the correction values set by user input as is, and causing the digging in amount of one of the curling roller pairs to be 0, the desired amount of curling can be applied to the sheet while decreasing total motor transporting torque.

Note that an example is shown here with the digging in amount, that is to say the curling amount, is 0. However, the curling amount only needs to be the smallest possible curling amount of the curling roller pair including the curling amount 0.

Note that the present embodiment is configured such that the correction values are distributed to the upper or lower curling roller pairs 201 and 202 in a case of correction values being correction values unable to be handled by changing only the curling force of the upper or lower curling roller pairs 201 and 202. The curling force of the upper or lower curling roller pairs 201 and 202 is determined according to this distribution, and the curling control unit 401*a* controls the curling amount adjustment mechanism for each of the curling amounts determined, which is the rotation of the eccentric cam 202*e* with the present embodiment.

Next, the curling force control, that is to say the adjustment of curling amount, will be described using the flowchart shown in FIGS. 7 and 8.

Figure 7:
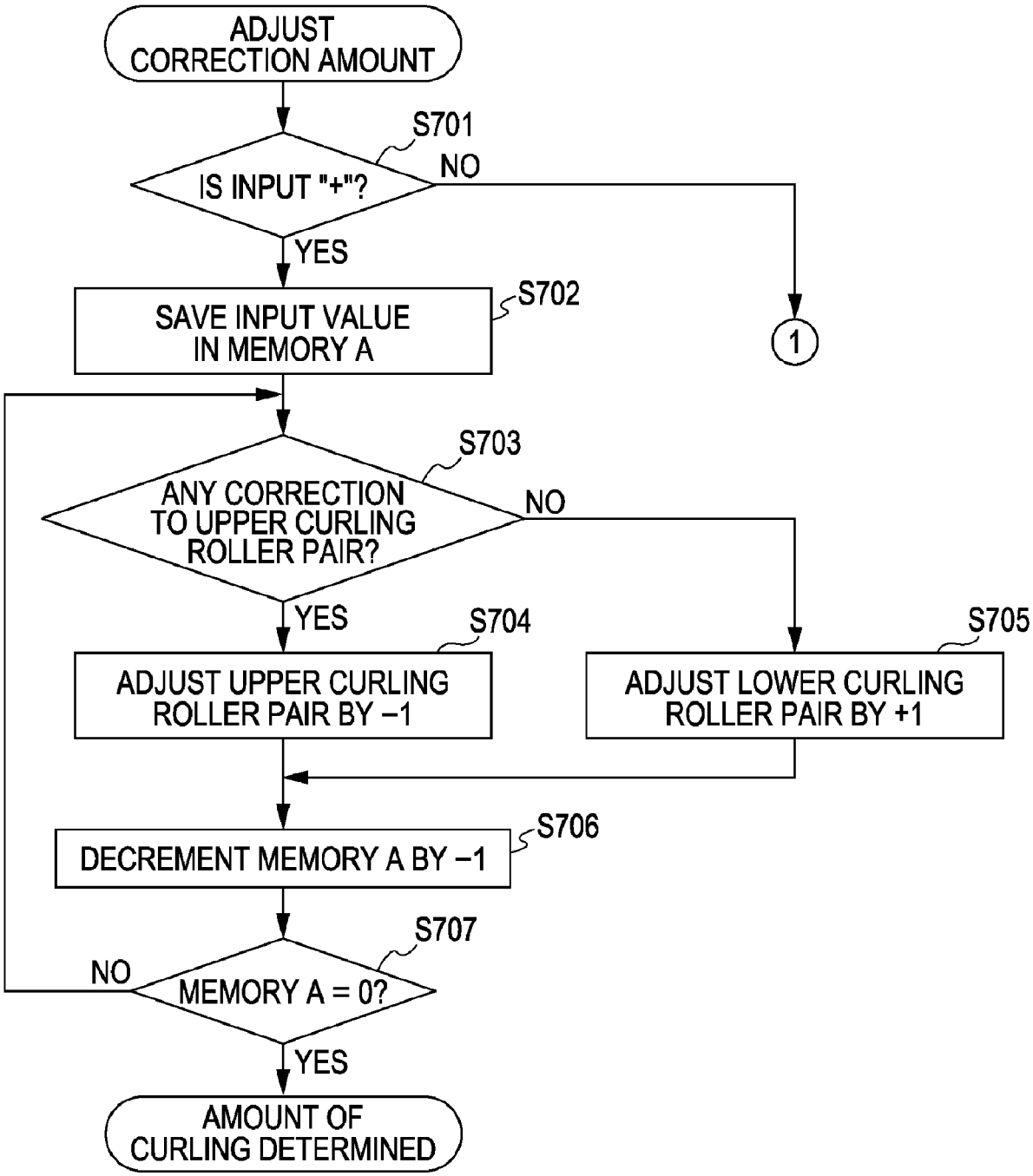
FIG. 7 is a first flowchart describing curling amount applying operation in a curling operation at the image forming apparatus.
Figure 8:
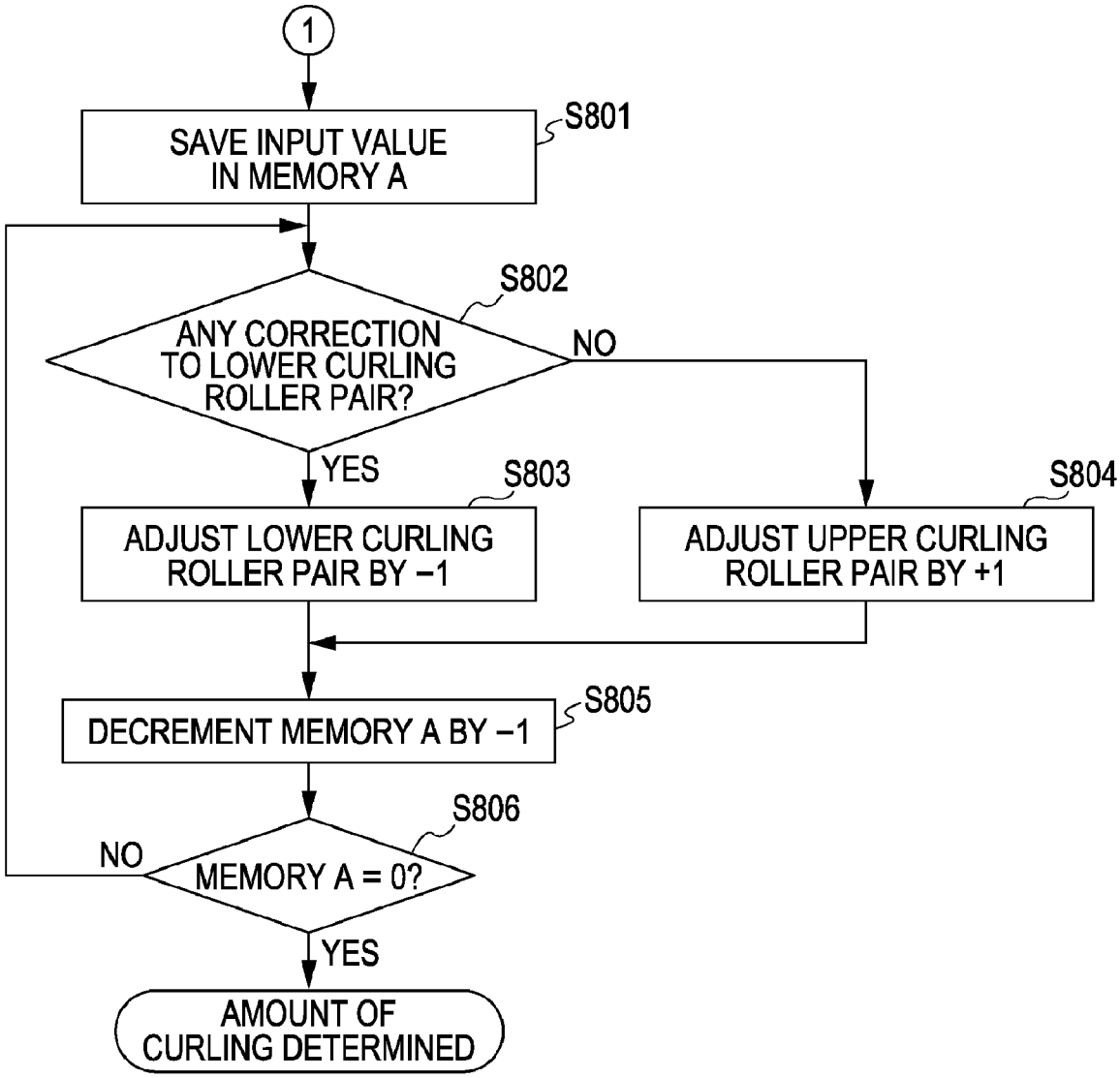
FIG. 8 is a second flowchart describing curling amount applying operation in a curling operation at the image forming apparatus.

First, in FIG. 7, the "+" and "−" show the correction direction by the user, and the curling amount to be corrected are set as manual input correction values. The set values are stored in a memory A. When sheet transporting is started, the job control unit 401 uniquely determines the curling amount of the sheet on which is a toner image from the toner amount. Prior to the sheet being inserted to the nip of the upper curling roller pair 201, the curling amount of the upper and lower curling roller pairs 201 and 202 is calculated again based on the manual input correction values.

Now, the manual input correction values input by the user is read from the memory, and determination is made as to whether the manual input correction value is "+" or "−" (S701). If the determination is "+", that is to say if the manual input correction value is the "+" which shows that correction is made (curling in the downward curling direction) so as to cause the sheet center portion to bow upwards (Yes in S701), the manual input correction amount without the sign (the offset value) is stored in the memory A (S702). For example, in the case of +5, a 5 is stored.

Next, determination is made as to whether a digging in amount of 1 through 5 is in the current curling roller pair 201 (S703). Here, if curling is already applied to the current curling roller pair 201 with the digging in amount 1 though 5 (Yes in S703), the digging in amount of the upper curling roller pair 201 is set as −1 (S704). The reason for not controlling the digging in amount of the lower curling roller pair 202 so as to increase has been described above.

Next, since the manual input correction amount is reflected only one stage worth, the value of the memory A is set to be −1 (S706), and determination is made as to whether the value of the memory A has become 0, that is to say, whether the manual input correction amounts have all been reflected (S707). In the case that the value of the memory A is not 0, that is to say in the case that manual input correction amount is not finished being reflected (No in S707), the flow advances to S703, and steps S703 through S707 are repeated. When the value of the memory A becomes 0 (Yes in S707), the curling amount of the lower curling roller pair 202 is determined.

Note that if the value of the memory A is thus sequentially changed by −1, the digging in amount of the upper curling roller pair 201 can become 0 by the time the value of memory A reaches 0. In this case, that is to say in the case that the curling amount of the upper curling roller pair 201 is no longer (No in S703), the digging in amount of the lower curling roller pair 202 then becomes +1 (S705). By repeating these calculations, the curling amounts of the upper curling roller pair 201 and lower curling roller pair 202 are determined.

On the other hand, in the case that the determination of the manual input correction values determines a "−" (No in S701), the manual input correction amount (offset value) without the sign is stored in the memory A (S801). For example, in the case of −3, a 3 is stored.

Next, determination is made as to whether a digging in amount of 1 through 5 is in the current lower curling roller pair 202 (S802). If there is already a digging in amount 1 through 5 (Yes in S802), the digging in amount of the lower curling roller pair 202 is set as −1 (S803). Also, if the digging in amount of the lower curling roller pair 202 is 0, the digging in amount of the upper curling roller pair 201 is set as +1 (S804).

Next, since the manual input correction amount is reflected only one stage worth, the value of the memory A is set to be −1 (S805), and determination is made as to whether the value of the memory A has become 0, that is to say, whether the manual input correction amounts have all been reflected (S806). In the case that the value of the memory A is not 0, that is to say in the case that manual input correction amount is not finished being reflected, the flow proceeds to step S802, and the steps S802 through S806 are repeated. When the value of the memory A becomes 0, the curling amount of the upper curling roller pair 201 and lower curling roller pair 202 is determined.

To list the above described control examples:

Lower curling roller pair: digging in amount 2

Upper curling roller pair: digging in amount 0

In the case that user input is "−2",

Lower curling roller pair: digging in amount 0

Upper curling roller pair: digging in amount 0

Also, in the case that user input is "+2",

Lower curling roller pair: digging in amount 4

Upper curling roller pair: digging in amount 0

Also, in the case that user input is "−3",

Lower curling roller pair: digging in amount 0

Upper curling roller pair: digging in amount 1

Thus, even if the manual input correction value has several values, the upper and lower curling roller pairs 201 and 202 will not both be in a digging in state, and one or the other will always have a digging in amount of 0.

Thus, by changing the curling amount thus determined and the digging in amount of the upper and lower curling roller pairs 201 and 202, the setting values from the user can be reflected as to the curling correction amount determined automatically from the toner amount.

Thus, by distributing the manually input correction values to change the curling amounts of the upper and lower curling roller pairs 201 and 202, the quality of curl-removing can be improved, even in the setting environment with various types of sheets and various temperature and humidity conditions. The correction values here are the correction values relating to the direction in which application is desired and the curling amount, as to the current situation settings. The curling amounts of the upper and lower curling roller pairs 201 and 202 are controlled so as to reflect the correction values thereof.

Also, when the manual correction by user input has been added, the sheet transport torque and motor driving electricity and so for can be suppressed by distributing the digging in amount so as to perform curling correction at one of the upper and lower curling roller pairs 201 and 202.

Now, since the user input can be arbitrarily input without relation to the actual curling, an incorrect input due to erroneous input operations can occur, resulting in too much curling and a paper jam. Therefore, for the curling rollers wherein the digging in amount is 0, a maximum digging in amount should be limited such as a maximum of 3, for example.

For example,

Lower curling roller pair: digging in amount 1

Upper curling roller pair: digging in amount 0

In the case of user input of "−5",

Lower curling roller pair: digging in amount 0

Upper curling roller pair: digging in amount 4

In this case, after the sheet passes through the upper curling roller pair 201, the upper curling may be too great for the sheet to be able to be discharged. Accordingly, for a curling roller pair wherein the digging in amount is determined to be 0 as a result of the automatic control, the user input value to be reflected is set at a maximum of digging in amount 3. That is to say, this is restricted to an amount smaller than the curling amount to be applied by the curling roller pair.

With the above example, a digging in amount 4 is restricted, so the digging in amount becomes 3.

As a result, the curling amount is determined as

Lower curling roller pair: digging in amount 0

Upper curling roller pair: digging in amount 3

Note that the description up to this point has shown examples wherein the curling amount (digging in amount) is automatically determined according to the sheet status by the job control unit 401 and is derived only by the toner amount. However, the state of the sheet can be derived from the digging amount from the sheet thickness, property values, or sheet size. Also, this information can be combined to automatically determine the curling amount. That is to say, a configuration may be made wherein the job control unit 401 can automatically determine the curling amount from the toner amount and the sheet thickness, for example.

Also, an example is given wherein as a result of automatic control, the digging in amount of a state reflecting the correction values from the user, as to a curling roller pair determined to have a digging in amount of 0 (minimum curling value), is 3 at the upper limit. The upper limit value can be changed according to the type of sheet. For example, a thin sheet can have an upper limit of 3 and a thick sheet can have an upper limit of 4.

Note that the present embodiment can operate to as to correspond to the cases wherein the correction values are input so as to have the maximum digging in amount which can be set by the curling roller pair, rather than setting an upper limit for the curling roller pair wherein a digging in amount is set, as a result of automatic control.

For example, with the above mentioned example, an upper limit is set for the input correction value as to the upper curling roller pair with a digging in amount of 0 as a result of automatic control. On the other hand, for the lower curling roller pair with a digging in amount of 1 as a result of automatic control, rather than setting an upper limit value to the input correction values, digging in may be permitted until the maximum curling force of the lower curling roller pair is reached.

Further, for the curling roller pair with a digging in amount determined to be 0, even if the user correction value reflected is input wherein the correction value has a digging in amount of 4 for example with an upper limit of digging in amount 3, the digging in amount 3 is not exceeded for actual apparatus operations.

However, with a user input unit (operating unit 400), a configuration may be made wherein the user cannot input a correction value exceeding the upper limit digging in amount for a curling roller pair wherein the digging in amount is determined to be 0 (minimum curling amount) as a result of automatic control. Note that the upper limit of the correction values can be changed according to the type of sheet, and so a configuration may be made wherein, depending on the type of sheet, the user cannot input a correction value exceeding the upper limit digging in amount.

By setting a limit to the additions of digging in amounts by user input for a curling roller pair wherein the digging in amount is determined to be 0 (minimum curling amount) by automatic control, paper jams and the like resulting from curling due to user input errors can be suppressed.

Also, a roller pair service as a unit for applying curling is shown as an example. However, the sheet can be curled by sandwiching a sheet between a rotating belt and a roller pressing against this belt.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-183895 filed Jul. 3, 2006, which is hereby incorporated by reference herein in its entirety.

What is claimed is:

1. A curling device comprising:

a curling portion having a first curling unit configured to curl a sheet in a first direction, and a second curling unit configured to curl a sheet which has passed the first curling device in a second direction opposite to the first direction;

an input unit facilitating manual input correction values including a curling correcting direction and a curling correcting amount to be corrected; and a control unit configured to control the curling portion so as to correspond to the correction values input in the input unit, wherein in a case in which a curling correcting direction input into the input unit is opposite to a predetermined curling direction in which the curling portion curls a sheet, the control unit controls so that a curling amount of one of the first curling unit and the second curling unit that curls a sheet in the predetermined direction is decreased.

2. The curling device according to claim 1, further comprising:

a curling amount determining unit configured to determine the predetermined curling direction of the curling portion and a curling amount of each of the first curling unit and the second curling unit according to a state of a sheet, wherein the control unit changes the curling amount of each of the first curling unit and the second curling unit determined by the curling amount determining unit so as to correspond to the correction values.

3. The curling device according to claim 1, wherein the control unit performs control so as to minimize the curling amount of the one of the first and second curling units which curls a sheet in the predetermined curling direction and the curling amount of the other of the first and second curling units is increased, in the case that the correction values are correction values which cannot be handled by changing the one of the curling amount of the first curling unit and the curling amount of the second curling unit which curls a sheet in the predetermined curling direction.

4. The curling device according to claim 2, wherein the curling amount determining unit determines the curling amount of each of the first curling unit and second curling unit such that the curling is performed by the one of the first and second curling units that curls a sheet in the predetermined curling direction and the curling amount of the other one of the first curling unit and the second curling unit is at minimum, and wherein the control unit performs control so as to restrict the curling amount of the first and second curling units, wherein the curling amount of the other of the first curling unit and the second curling unit that is determined by the curling amount determining unit to be at minimum, to be a smaller amount than a maximum curling amount capable by the other of the first and second curling units, in the event that the control unit controls each curling amount of the first curling unit and the second curling unit to correspond to the correction values input into the input unit.

5. The curling device according to claim 4, wherein an upper limit value of the curling amount of the other of the first and second curling units is changed according to a type of sheet.

6. The curling device according to claim 2, wherein the curling amount determining unit determines the curling amount of each of the first curling unit and the second curling unit such that the curling is performed by the one of the first and second curling units that curls a sheet in the predetermined curling direction and the curling amount of the other of the first and second curling units is at minimum, and wherein correction values which can be input at the input unit are set such that the curling amount of the other of the first and second curling units is restricted to be a smaller amount than the maximum curling amount capable by the other of the first and second curling units.

7. The curling device according to claim 6, wherein the upper limit of a correction value capable of inputting into the input unit changes according to a type of sheet.

8. The curling device according to claim 2, wherein the curling amount determining unit determines the curling amount of each of the first and second curling units based on an amount of toner transferred to a sheet or on the type of sheet.

9. An image forming apparatus comprising:

an image forming unit configured to form an image on a sheet;

a fusing device configured to fuse the image formed at the image forming unit onto the sheet; and the curling device according to claim 1, configured to curl a sheet which has passed through the fusing device.

10. The curling device according to claim 1, wherein in the case in which the curling correcting direction input into the input unit is opposite to the predetermined curing direction in which the curling portion curls a sheet and in which a curl correction amount input into the input unit is larger than a predetermined curling amount in the predetermined curling direction, a curling amount of the other of the first curling unit and the second curling unit is increased.

* * * * *